United States Patent [19]

Metz

[11] Patent Number: 4,644,904

[45] Date of Patent: Feb. 24, 1987

[54] GAS FIRED HEATING BOILER

[75] Inventor: Peter Metz, Meuhltal, Fed. Rep. of Germany

[73] Assignee: Hydrotherm Geraethebau GmbH, Dieburg, Fed. Rep. of Germany

[21] Appl. No.: 705,195

[22] Filed: Feb. 25, 1985

[30] Foreign Application Priority Data

Feb. 23, 1984 [DE] Fed. Rep. of Germany ..... 3406503

[51] Int. Cl.[4] ..... F22B 5/00

[52] U.S. Cl. ..... 122/13 R; 122/16; 122/17; 126/350 R

[58] Field of Search ..... 122/13 R, 16, 17; 126/350 R; 236/15 C

[56] References Cited

U.S. PATENT DOCUMENTS

| | | | |
|---|---|---|---|
| 788,890 | 5/1905 | Deasy | 122/16 |
| 3,707,142 | 12/1972 | Kobayashi | 122/13 R |
| 3,964,675 | 6/1976 | Euchner, Jr. | 236/15 C |
| 4,192,323 | 3/1980 | Horne | 432/500 |
| 4,205,631 | 6/1980 | Parker | 236/15 C |
| 4,253,426 | 3/1981 | Nishi et al. | 122/17 |
| 4,338,888 | 7/1982 | Gertsmann et al. | 122/16 |
| 4,393,814 | 7/1983 | Sievert | 122/2 |
| 4,401,058 | 8/1983 | Charrier et al. | 122/17 |
| 4,465,024 | 8/1984 | Adams | 122/17 |
| 4,502,395 | 3/1985 | Barrett | 110/214 |

*Primary Examiner*—Henry C. Yuen

*Attorney, Agent, or Firm*—Robert J. Koch

[57] ABSTRACT

A gas-fired heating boiler without a blower, with partial load controls, comprises a combustion chamber with heat exchanger elements located above the combustion chamber, a Venturi tube with a nozzle and an air damper arranged in the wall of the combustion chamber. Partial amounts of the air required for combustion are suctioned into the combustion chamber through the Venturi tube and air damper, respectively. The combustion chamber is open toward the heat exchanger elements at its further walls. The air damper is sealed tightly at its edges against the undesirable entry of air into the combustion chamber. The Venturi tube has a cross section which limit the flow of combustion air to a constant partial amount of the air required for full load operation. An opening is provided in the air damper, calibrated for the flow of the difference air volume required in addition to the air flowing through the Venturi tube for the optimum efficiency of the burner in the partial load operation desired. The Venturi tube advantageously has a cross section whereby the flow of air into the combustion chamber is limited to a proportion of between $\frac{1}{3}$ and $\frac{2}{3}$, preferably to less than one-half of the air required for a full load operation. In the air damper a window opening is provided, into which a replaceable diaphragm disk comprises a calibrated bore. The edges are also sealed against the undesirable entry of a flow of air.

7 Claims, 2 Drawing Figures

FIG. 1
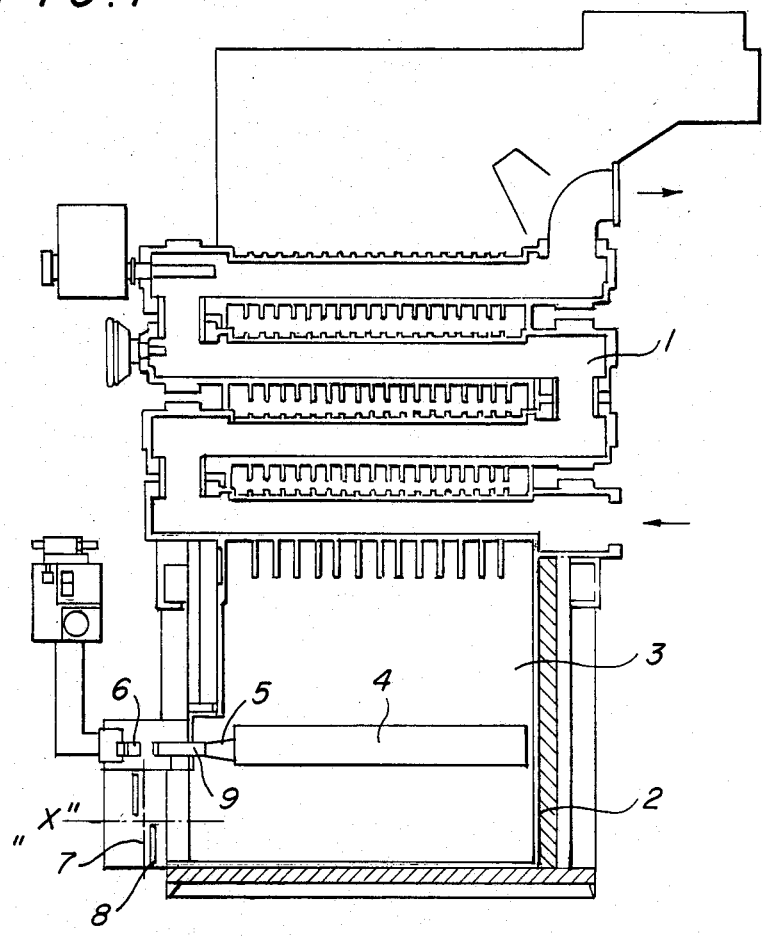
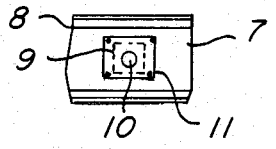
FIG. 2

GAS FIRED HEATING BOILER

BACKGROUND OF THE INVENTION

1. Field of the Invention

The invention relates to a gas heating boiler with a burner and without a blower, with partial load control, comprising a combustion chamber a plurality of heat exchanger elements located above said combustion chamber a Venturi tube with a nozzle and an air damper in the wall of the combustion chamber, through which the partial air volumes required for the combustion process are suctioned into the combustion chamber.

2. Background of the Art

It is known that, with respect to the time interval constituting a heating period, heating boilers for the heating of dwelling space exhibit a mean load amounting only to approximately 25% of total time. As the result of this low rate of utilization high standby losses occur caused in particular by the convective air flow through the boiler during the long downtime periods, whereby the heat of the boiler is transferred by the waste gas exhaust to the atmosphere. While the throttling of the burner to extend operating periods without interfering with the utilization of combustion air leads to the desired reduction of downtime losses, it also results in a disproportional decline in the operating efficiency of the boiler, so that this method of solving the problem is not feasible.

It is known to operate gas fired heating boilers in a so-called "modulated burner mode" in order to eliminate this disadvantage, whereby—by means of gas jet pressure regulation—the volume of the combustion gas is controlled and therefore the air suctioned through the Venturi tube modified to some extent. All measurements in this area have demonstrated, however, that this mode of operation does not lead to an appreciable increase in boiler efficiency, as while if the pressure at the jet is reduced, the air suctioned in through the Venturi tube is also reduced to an approximately proportional extent. On the other side the so-called secondary air component suctioned in by the flame not only remains practically unchanged, but is even increased in part. The result is that if the pressure at the jet is reduced, the excess air is increased, which overall leads to a reduction of boiler efficiency in spite of the decreasing flue gas temperatures, which cannot be compensated for by the reduction in standby losses achieved. Altogether therefore this method does not lead to an improvement in the annual efficiency which is decisive in view of boiler efficiency.

To eliminate the aforedescribed disadvantages, it is further known to introduce the secondary air component through an air damper arranged in the housing under the burner and to control it by that the damper is opened and closed continuously in a proportional dependence on the gas pressure determined by the jet of the burner. A solution of this type is sensitive—in addition to the high cost—in view of the necessary accurate coupling of the gas supply and the position of the damper. It further has little flexibility as the gas pressure and thus the output must be regulated as a function of gas quality by the position of the air damper.

It is finally known to insert dampers into the path of the flue gases, which in case of a partial load stage partially close the flue gas conduit, whereby the flow resistance is increased and thus the supply of secondary air reduced. In this case a reduction of boiler efficiency in the half load stage is avoided, but the disadvantage of the solution, in addition to the low flexibility represented by the exact adjustment of the partial load stage as a function of the prevailing gas quality, consists of a reduction in safety, as throttles or closures in the flue gas conduit by means of moving inserts are considered a risk factor. Furthermore, dampers of this type must always be provided with a certain clearance to insure their frictionless movement at the prevailing temperature.

SUMMARY OF THE INVENTION

An object of the present invention is to provide a gas fired heating boiler of the aforedescribed type, capable of safe adjustments to obtain optimum burner behavior, thereby assuring an improved boiler efficiency in a technically simple and thus cost effective manner. The invention comprises a combustion chamber that is open toward the heat exchanger elements and tightly sealed at its further walls and the air damper at its edges, against the entry of a false flow of air into the combustion chamber, a Venturi tube having a cross section limiting the intake of combustion air to a constant partial amount of the air volume required for operation under a full load and an orifice is provided in the air damper, said orifice being calibrated for the inflow of the difference air volume required in addition to the partial amount of air flowing through the Venturi tube for the optimum efficiency of the burner in the partial load operation desired.

The invention provides a gas-fired heating boiler permitting in a technically simple and thus cost effective manner the safe adjusting of the burner to obtain optimum burner behavior, while simultaneously providing an improvement in burner efficiency, whereby by means of the adjustment of the output of the burner to the prevailing requirements, downtimes are significantly reduced and therefore standby losses appreciably lowered.

In an advantageous embodiment of the invention the Venturi tube has a cross section whereby the supply of air to the combustion chamber is limited to a proportion between $\frac{1}{3}$ and $\frac{2}{3}$, preferably to less than one-half of the air volume required for full load operation. In another preferred embodiment, a window opening is provided in the air damper, with a replaceable diaphragm disk comprising the adjustable or calibrated bore being held in the opening and its edges sealed against the entry of a flow of false air. In this manner, the continuous or step wise adjustment of the boiler from a full load to the partial load desired becomes possible within the range of the usual operating requirements. In this manner, a portion of the combustion air is supplied as the primary air through the Venturi tube and the additional air needed for combustion is introduced in the optimum amount depending on the prevailing setting of the burner output introduced as the secondary air. The flow is adjustable in a highly accurate manner by means of the replaceable calibrated bores.

The calibrated opening or calibrated openings are placed appropriately in the air damper located in the front wall of the housing also carrying the burner. As an alternative, several calibrated bores may be arranged in the front wall of the housing or additionally to in another housing wall or optionally in a distribution scheme over several different housing walls, in different height and lateral positions. The optimalization of the behavior of the burner in keeping with local or objective conditions, may be obtained in this fashion.

BRIEF DESCRIPTION OF THE DRAWING

The invention is illustrated in the drawing as follows:

FIG. 1 shows a schematic longitudinal section view of gas fired heating boiler.

FIG. 2 illustrates a view of the air damper of the boiler.

The gas fired heating boiler shown in the drawing comprises combustion chamber 3 enclosed by the housing wall 2, together with the heat exchanger elements 1, located above the combustion chamber and forming the boiler block. In the housing wall 2, the burner 4, a Venturi tube 5 with a nozzle 6, and an air damper are arranged, through which partial amounts of the air required for combustion are suctioned in the combustion chamber 3. The combustion chamber 3, which is open toward the heat exchanger elements 3 at its further walls and the air damper 7 at its edges, are tightly sealed against the the entry of an undesirable or "false" flow of air into the combustion chamber 3. The Venturi tube 5 has a cross section limiting the inflow of the combustion air to a constant partial volume of the amount of air required for a full load operation. An opening 10 is provided in the air damper 7. The air damper is sealed at its edges against the intake of a flow of false air by means of sealing strips 8. The opening is calibrated for the flow of the difference air volume into the combustion chamber 3, required in addition to the air flowing through the Venturi tube for the optimum efficiency of the burner in the partial load operation desired. In the embodiment of a gas fired boiler according to the invention shown in the drawing (with the limitation of the flow of air into the combustion chamber 3 through the Venturi tube to a proportion of $\frac{1}{3}$ to $\frac{2}{3}$, preferably less than one-half of the amount of air required for full load operation) a window opening is arranged in the air damper, wherein a replaceable diaphragm disk 11 comprising the adjustable or calibrated bore 10 is set, with its edges being sealed against the entry of false air.

In place of the calibrated bore arranged in the front wall of the housing or additionally to said bore, in another housing wall or optionally in a distribution over several different housing walls, in various height and lateral positions, further calibrated bores may be provided.

What is claimed is:

1. A gas-fired heating boiler comprising:

a combustion chamber with a plurality of heat exchanger elements in open communication therewith;

a first and second means for intake of combustion air into the combustion chamber, wherein said first means for intake of combustion air is a Venturi tube in the wall of said combustion chamber;

and said second means for intake of combustion air is an air damper in the wall of said combustion chamber for supplying variable amounts of air to said combustion chamber;

means for supplying combustion air to said Venturi tube and said siar damper; and wherein said combustion chamber, Venturi tube and air damper are sealed against the flow of uncontrolled air into said combustion chamber;

wherein said Venturi tube has a cross section and volume which limits the flow of combustion air to a constant partial amount of the volume required in a full load operation of said boiler and said air damper further comprises an opening in said combustion chamber wall calibrated for the flow of an amount of combustion air which in addition to the constant partial amount is sufficient for optimum efficiency of combustion in said combustion chamber; and wherein said opening in said combustion chamber comprises a window or opening for said air damper and a replaceable diaphragm disk for calibrating the flow of combustion air.

2. The gas-fired heating boiler of claim 1, wherein said Venturi tube cross section permits from between $\frac{1}{3}$ and $\frac{2}{3}$ of the amount of air required for full load operation of said boiler.

3. The gas-fired heating boiler of claim 2, wherein said Venturi tube cross section permits from between $\frac{1}{3}$ and $\frac{1}{2}$ of the amount of air required for full load operation of said boiler.

4. The gas-fired heating of claim 3, wherein said window opening is sealed against the flow of uncontrolled air into said combustion chamber.

5. The gas-fired heating boiler of claim 4, wherein said replaceable diaphragm in said window opening comprises a calibrated bore.

6. The gas-fired heating boiler of claim 5, further comprising at least one additional calibrated bore in said combustion chamber wall.

7. The gas-fired heating boiler of claim 1 wherein said combustion chamber is a blowerless chamber.

* * * * *